US008162049B2

(12) United States Patent
Rose

(10) Patent No.: US 8,162,049 B2
(45) Date of Patent: Apr. 24, 2012

(54) INJECTION-BACKFLOW TECHNIQUE FOR MEASURING FRACTURE SURFACE AREA ADJACENT TO A WELLBORE

(75) Inventor: Peter E. Rose, Salt Lake City, UT (US)

(73) Assignee: University of Utah Research Foundation, Salt Lake City, UT (US)

( * ) Notice: Subject to any disclaimer, the term of this patent is extended or adjusted under 35 U.S.C. 154(b) by 0 days.

(21) Appl. No.: 12/814,148

(22) Filed: Jun. 11, 2010

(65) Prior Publication Data

US 2010/0314105 A1 Dec. 16, 2010

Related U.S. Application Data

(60) Provisional application No. 61/186,507, filed on Jun. 12, 2009.

(51) Int. Cl.
*E21B 47/00* (2012.01)
*E21B 43/26* (2006.01)

(52) U.S. Cl. ..... 166/250.12; 166/250.1; 166/308.1

(58) Field of Classification Search ..... None
See application file for complete search history.

(56) References Cited

U.S. PATENT DOCUMENTS

| | | | | |
|---|---|---|---|---|
| 3,195,630 | A | 7/1965 | Fisher | |
| 3,390,723 | A | 7/1968 | Hower et al. | |
| 3,526,097 | A | 9/1970 | Nelson | |
| 3,942,101 | A | 3/1976 | Saye et al. | |
| 3,960,736 | A | 6/1976 | Free et al. | |
| 4,055,399 | A | 10/1977 | Parrish | |
| 4,126,406 | A | 11/1978 | Traylor et al. | |
| 4,223,729 | A | 9/1980 | Foster | |
| 4,278,128 | A * | 7/1981 | Satter et al. | 166/250.16 |
| 4,520,666 | A | 6/1985 | Coblentz et al. | |
| 4,559,818 | A | 12/1985 | Tsang et al. | |
| 4,573,537 | A | 3/1986 | Hirasuna | |
| 4,577,679 | A | 3/1986 | Hibshman | |
| 4,716,964 | A | 1/1988 | Erbstoesser et al. | |
| 4,749,035 | A | 6/1988 | Cassity | |
| 4,832,121 | A * | 5/1989 | Anderson | 166/250.09 |
| 4,926,949 | A | 5/1990 | Forrest | |
| 4,976,142 | A | 12/1990 | Perales | |

(Continued)

FOREIGN PATENT DOCUMENTS

EP 0338154 A1 10/1989

(Continued)

OTHER PUBLICATIONS

Greatly Enhanced Delectability of Geothermal Tracers Through Laser-Induced Fluorescence, Peter E. Rose, et al. Oct. 30, 2002; 10 pages.

(Continued)

*Primary Examiner* — Angela M DiTrani
(74) *Attorney, Agent, or Firm* — Sanjeet Dutta; King & Spalding LLP

(57) ABSTRACT

An injection backflow method for measuring fracture surface area adjacent to a wellbore measures an initial temperature profile along the length of a wellbore. A tracer composition is injected into the wellbore at an initial concentration. The tracer composition includes a reactive tracer and a secondary tracer that is less reactive than the reactive tracer. The tracer composition diffuses within subterranean reservoir for a time. A secondary tracer concentration and a reactive tracer concentration are measured as a function of time. A reservoir fracture surface area is calculated using a reservoir fluid flow model.

18 Claims, 4 Drawing Sheets

U.S. PATENT DOCUMENTS

| | | | | |
|---|---|---|---|---|
| 5,143,155 | A | 9/1992 | Ferris et al. | |
| 5,163,321 | A | 11/1992 | Perales | |
| 5,165,235 | A | 11/1992 | Nitschke | |
| 5,246,860 | A | 9/1993 | Hutchins et al. | |
| 5,515,679 | A | 5/1996 | Shulman | |
| 5,595,245 | A | 1/1997 | Scott, III | |
| 5,723,781 | A | 3/1998 | Pruett et al. | |
| 5,890,536 | A | 4/1999 | Nierode et al. | |
| 5,931,000 | A | 8/1999 | Turner et al. | |
| 5,944,446 | A | 8/1999 | Hocking | |
| 6,016,191 | A | 1/2000 | Ramos et al. | |
| 125,934 | A | 10/2000 | Lenn et al. | |
| 6,291,404 | B2 | 9/2001 | House | |
| 6,543,538 | B2 | 4/2003 | Tolman et al. | |
| 6,659,175 | B2 | 12/2003 | Malone | |
| 6,758,271 | B1 | 7/2004 | Smith | |
| 7,032,662 | B2 | 4/2006 | Malone et al. | |
| 7,207,389 | B2 | 4/2007 | Foster et al. | |
| 7,265,079 | B2 | 9/2007 | Willberg et al. | |
| 7,296,625 | B2 | 11/2007 | East, Jr. | |
| 7,299,873 | B2 | 11/2007 | Hartman et al. | |
| 7,347,260 | B2 * | 3/2008 | Ferguson et al. | 166/250.12 |
| 7,523,024 | B2 | 4/2009 | Endres et al. | |
| 7,565,929 | B2 | 7/2009 | Bustos et al. | |
| 2003/0079877 | A1 | 5/2003 | Wellington et al. | |
| 2004/0074642 | A1 | 4/2004 | Price-Smith et al. | |
| 2004/0094297 | A1 | 5/2004 | Malone et al. | |
| 2006/0113077 | A1 | 6/2006 | Willberg et al. | |
| 2006/0144588 | A1 | 7/2006 | Ferguson et al. | |
| 2007/0083331 | A1 | 4/2007 | Craig et al. | |
| 2007/0223999 | A1 | 9/2007 | Curlett | |
| 2007/0272407 | A1 | 11/2007 | Lehman et al. | |
| 2008/0026956 | A1 | 1/2008 | Shinbach et al. | |
| 2008/0083536 | A1 | 4/2008 | Cavender et al. | |
| 2008/0128108 | A1 | 6/2008 | Clark | |
| 2008/0133193 | A1 * | 6/2008 | Gdanski et al. | 703/10 |
| 2008/0210423 | A1 | 9/2008 | Boney | |
| 2008/0236823 | A1 | 10/2008 | Willberg et al. | |
| 2009/0037112 | A1 | 2/2009 | Soliman et al. | |
| 2009/0065253 | A1 | 3/2009 | Suarez-Rivera et al. | |

FOREIGN PATENT DOCUMENTS

| | | | |
|---|---|---|---|
| EP | 0357317 | A | 3/1990 |
| EP | 0435430 | A1 | 7/1991 |
| EP | 1980604 | A | 10/2008 |
| GB | 2288694 | A | 10/1995 |
| WO | WO 99/05394 | A | 2/1999 |
| WO | WO 2004/076815 | A | 9/2004 |
| WO | WO 2005/001242 | A2 | 1/2005 |
| WO | WO 2006/002325 | A2 | 1/2006 |
| WO | WO 2008/064074 | | 5/2008 |
| WO | WO 2008/107831 | A2 | 9/2008 |
| WO | WO 2008/122114 | | 10/2008 |
| WO | WO 2008/156970 | | 12/2008 |

OTHER PUBLICATIONS

Kinetics of Fluorescein Decay and Its Application As a Geothermal Tracer; Michael Adams and Jon Davis; vol. 20, No. 1/2; pp. 53-66, 1991.

WO PCT/US2010/038420—Search Report, Aug. 18, 2010.

WO PCT/US2010/036969—Search Report, Jul. 21, 2010.

WO PCT/US2009/042421—Search Report, Sep. 14, 2009.

WO PCT/US2009/042137—Search Report, Aug. 21, 2009.

WO PCT/US2009/049844—Search Report, Dec. 17, 2009.

WO PCT/US2009/053304—Search Report, Mar. 11, 2009.

WO PCT/US2010/030013—Search Report, Jun. 7, 2010.

WO PCT/US2009/054536—Search Report, Nov. 18, 2009.

Tester et al, The Future of thermal energy: Impact of Enhanced Geothermal Systems (EGS) on the United States in the 21st Century: (Retrieved from the Internet, <URL: geothermal.inel.gov/publications/future_or_geothermal_energy.pdf>) 2006, 372 pgs.

Biopolymers: overview of several properties and consequences on their applications; K. Van de Velde and P. Kiekens; Department of Textiles, Ghent University, Sep. 11, pp. 433-442.

Components on High Temperature Plugs: Progress Report on Polymers and Silicates: S. Bauer, D. Galbreath, J. Hamilton and A. Mansure; Geothermal Resources Council Transactions, vol. 28, Aug. 29-Sep. 1, 2004, pp. 145-152.

Components on High Temperature Plugs: Progress Report on Polymers and Silicates; S. Bauer, D. Galbreath, J. Hamilton and A. Mansure; Geothermal Resources Council Transactions, vol. 28, Aug. 29-Sep. 1, 2004, pp. 145-152.

* cited by examiner

INJECTION-BACKFLOW TECHNIQUE FOR MEASURING FRACTURE SURFACE AREA ADJACENT TO A WELLBORE

This application claims priority to U.S. Provisional Application No. 61/186,507, filed Jun. 12, 2009 which is incorporated herein by reference.

FIELD

The field of the invention, relates generally to subterranean structures. In particular, the present invention is directed to an injection backflow technique for measuring fracture surface area adjacent to a wellbore.

BACKGROUND

It is often desirable to increase the fracture surface area within a geothermal reservoir or within an Engineered Geothermal System because increases in surface area can be equated to increased rates of energy extraction. The conventional method of increasing surface area is through a hydraulic stimulation procedure wherein large volumes of water are injected at moderate flow rates over several days. Currently, effectiveness of the stimulation procedure is determined by measuring and correlating decreases in pressure as a result of pumping. For example, for a given flow rate, a wellhead pressure drop can be assumed to correlate with an increase in injectivity due to an increase in the number and/or size of fractures. Subsequent pressure, temperature, and/or spinner logging can help to quantify the creation of new fractures.

SUMMARY

An injection backflow technique for measuring fracture surface area adjacent to a wellbore is disclosed. According to one embodiment, a method comprises measuring an initial temperature profile along the length of a wellbore. A tracer composition is injected into the wellbore at an initial concentration. The tracer composition includes a reactive tracer and a secondary tracer that is less reactive than the reactive tracer. The tracer composition diffuses within subterranean reservoir for a time. A secondary tracer concentration and a reactive tracer concentration are measured as a function of time. A reservoir fracture surface area is calculated using a reservoir fluid flow model.

There has thus been outlined, rather broadly, the more important features so that the detailed description thereof that follows may be better understood, and so that the present contribution to the art may be better appreciated. Other features will become clearer from the following detailed description, taken with the accompanying drawings, or may be learned by the practice of the invention.

BRIEF DESCRIPTION OF THE DRAWINGS

The present embodiments will become more fully apparent from the following description and claims, taken in conjunction with the accompanying drawings. Understanding that these drawings merely depict exemplary embodiments and they are, therefore, not to be considered limiting of its scope. It will be readily appreciated that the components, as generally described and illustrated in the figures herein, could be arranged, sized, and designed in a wide variety of different configurations. Nonetheless, the present system will be described and explained with additional specificity and detail through the use of the accompanying drawings in which:

Figure 1:
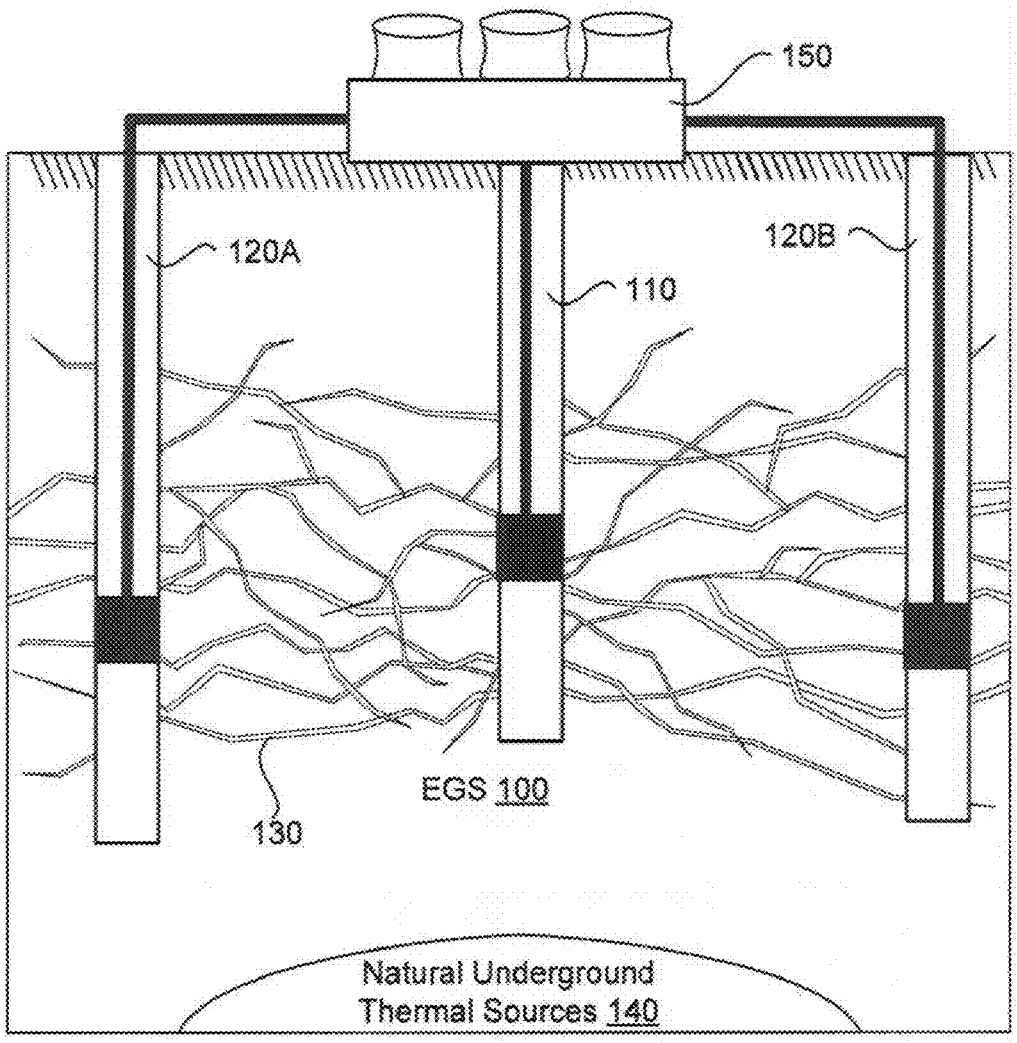
FIG. 1 is a simplified schematic of an EGS in accordance with one embodiment showing one injection well and two production wells.

It should be noted that the figures are not necessarily drawn to scale and that elements of similar structures or functions are generally represented by like reference numerals for illustrative purposes throughout the figures. It also should be noted that the figures are only intended to facilitate the description of the various embodiments described herein. The figures do not describe every aspect of the teachings described herein.

DETAILED DESCRIPTION OF EXEMPLARY EMBODIMENTS

In the creation of an Engineered Geothermal System (EGS), it is desirable to maximize the fracture density. This is because, as with any heat exchanger, heat transfer efficiency increases with fracture surface area. Well injectivity, however, can be increased either by increasing the apertures of one (or a few) fracture(s) or by increasing the number of fractures over a given interval (fracture density). The present system differentiates between mere increases in injectivity and increases in fracture surface area adjacent to a stimulated EGS wellbore.

A method of measuring a surface area of a subterranean reservoir adjacent a geothermal well can include measuring ah initial temperature profile along the length of a wellbore and using it to estimate the initial formation temperature adjacent the wellbore. A mixture of tracers can be injected into the well. The tracer mixture can include a conservative tracer and a reactive tracer. The well can be shut in to allow the tracer mixture to diffuse within subterranean reservoir for an extended time. As the well is then flowed to the surface, a conservative tracer concentration and a reactive tracer concentration can be measured as a function of time subsequent to the extended time. Based upon knowledge of the decay kinetics of the thermally reactive tracer, a reservoir fracture surface area can be calculated using a reservoir fluid flow model.

The tracer mixture includes both a conservative tracer and a reactive tracer. The conservative tracer provides a dilution history or reference, while the reactive tracer can provide data sufficient to construct a temperature history. Alternatively, the tracer mixture could include a slightly or moderately reactive tracer in combination with a more reactive tracer. The important feature of the tracer mixture is that there is a measurable difference in the thermal decay kinetics between the tracers and that the thermal decay kinetics of each is known. Typically, tracers are chemically distinctive powders dissolved in aqueous solution. Alternatively, they can be chemically distinctive liquid compounds dissolved in an aqueous solution.

Thermally stable tracers are compounds that do not decompose during a reasonable time (months to years) at a given reservoir temperatures. Therefore, some compounds that are thermally stable at a certain temperature are thermally unstable at other (higher) temperatures. Tracers that are thermally stable under all subterranean conditions include, but are not limited to deuterated water, alkali metals, alkaline-earth metals, and halides. Likewise, the benzene- and naphthalene sulfonates are thermally stable at subterranean temperatures below 340° C. Na fluorescein (uranine) is thermally stable below about 250° C.

Reactive tracers can include, but are not limited to esters, amines, aryl halides, rhodamine WT, eosin Y, Oregon Green™, halogenated fluoresceins, and combinations thereof. In one specific aspect, the conservative tracer is 2,6-naphthalene disulfonate. Typically, it is desirous that the mixture of conservative and reactive tracers be in a 1:1 ratio. However, other ratios can be suitable.

The concentration of either or both of the reactive and conservative tracers can depend on the particular tracer composition. More specifically, different tracer compounds are more or less sensitive to detection. Optimal detection systems can also depend on the particular compounds. Detection systems can include, but are not limited to, high-performance liquid chromatography (HPLC) with fluorescence or UV detection, spectrofluorimetry, filter fluorimetry, absorption spectroscopy, and the like. The initially injected tracer quantity can be enough to result in a produced concentration from about 0.1 ppb to about 100 ppb, such as about 0.1 ppb to about 100 ppb.

The geothermal well can be optionally shut-in during the step of allowing the tracer to diffuse. Any shut-in duration can be used so long as the duration is not so long that it results in the complete thermal degradation of the reactive tracer. This can range from several minutes to several days, e.g. 10 minutes to 4 hours or more. If downhole sampling is available, the well can be sampled without backflowing. More typical, however, the well can be allowed to backflow after stimulation. More specifically, the method can accompany the stimulation of the subterranean reservoir to increase the reservoir fracture surface area. In this case, injecting the tracer can occur during the step of stimulating the formation and the measuring of the dilution concentration occurs during a backflow of fluid from the subterranean reservoir.

The tracer composition concentrations can be measured at a wellhead of the geothermal well and optionally along the well depth. Further, the concentrations can be measured as a function of time during or immediately after stimulation and/or shut-in. Immediately after is intended to refer to a time frame where backflow is sufficient to allow measurement of fluids from the fracture. The concentrations can be measured as a function of time over several hours to days or weeks.

Based on the collected tracer concentration measurements and a wellbore temperature profile, the fracture surface area can be calculated using a corresponding reservoir fluid flow model. An inversion technique can be applied to the reservoir fluid flow model which includes a thermal decay model of the reactive tracer. In this manner, the reservoir fracture surface area which predicts the ratio of the reactive tracer concentration to that of the conservative tracer concentration as a function of time can be calculated. Although other models can be suitable, one particularly effective reservoir fluid flow model is TOUGH2.

The following detailed description of exemplary embodiments makes reference to the accompanying drawings, which form a part hereof and in which are shown, by way of illustration, exemplary embodiments which may be practiced. While these exemplary embodiments are described in sufficient detail to enable those skilled in the art to practice the invention, it should be understood that other embodiments may be realized and that various changes may be made without departing from the spirit and scope of the present invention. Thus, the following more detailed description of the embodiments is not intended to limit its scope, but is presented for purposes of illustration only and not limitation to describe its features and characteristics, to set forth the best mode, and to sufficiently enable one skilled in the art to practice the present embodiments.

DEFINITIONS

In describing the present embodiments, the following terminology will be used.

The singular forms "a," "an," and "the" include plural referents unless the context clearly dictates otherwise. Thus, for example, reference to "a tracer" includes reference to one or more of such materials and reference to "injecting" refers to one or more such steps.

As used herein with respect to ah identified property or circumstance, "substantially" refers to a degree of deviation that is sufficiently small so as to not measurably detract from the identified property or circumstance. The exact degree of deviation allowable may in some cases depend on the specific context.

As used herein, "adjacent" refers to the proximity of two structures or elements. Particularly, elements that are identified as being "adjacent" may be either abutting or fluidly connected. Such elements may also be near or close to each other without necessarily contacting each other. The exact degree of proximity may in some cases depend on the specific context.

As used herein, "conservative tracer" refers to a chemical compound which is substantially inert during the process, including thermal degradation and/or reaction with other solutes and/or the formation rock.

As used herein, "reactive tracer" refers to a chemical compound which is not thermally stable during the process such that a substantial and measurable portion of the tracer is lost due to thermal degradation and/or reaction with other species in the formation. Reactive tracers can have a range of thermal instabilities which affect their rate of decomposition and thus their useful life.

As used herein, a plurality of items, structural elements, compositional elements, and/or materials may be presented in a common list for convenience. However, these lists should be construed as though each member of the list is individually identified as a separate and unique member. Thus, no individual member of such list should be construed as a de facto equivalent of any other member of the same list solely based on their presentation in a common group without indications to the contrary.

Concentrations, amounts, and other numerical data may be presented herein in a range format. It is to be understood that such range format is used merely for convenience and brevity and should be interpreted flexibly to include not only the numerical values explicitly recited as the limits of the range, but also to include all the individual numerical values or sub-ranges encompassed within that range as if each numerical value and sub-range is explicitly recited. For example, a numerical range of about 1 to about 4.5 should be interpreted to include not only the explicitly recited limits of 1 to about 4.5, but also to include individual numerals such as 2, 3, 4, and sub-ranges such as 1 to 3, 2 to 4, etc. The same principle applies to ranges reciting only brie numerical value, such as "less than about 4.5," which should be interpreted to include all of the above-recited values and ranges. Further, such an interpretation should apply regardless of the breadth of the range or the characteristic being described.

In the present disclosure, the term "preferably" or "preferred" is non-exclusive where it is intended to mean "preferably, but not limited to."

Any steps recited in any method or process claims may be executed in any order and are not limited to the order presented in the claims. Means-plus-function or step-plus-function limitations will only be employed where for a specific claim limitation all of the following conditions are present in that limitation: a) "means for" or "step for" is expressly recited; and b) a corresponding function is expressly recited. The structure, material or acts that support the means-plus function are expressly recited in the description herein. Accordingly, the scope of the invention should be determined solely by the appended claims and their legal equivalents, rather than by the descriptions and examples given herein.

Surface Area Measurement Using Tracer Mixtures

Figure 2A:
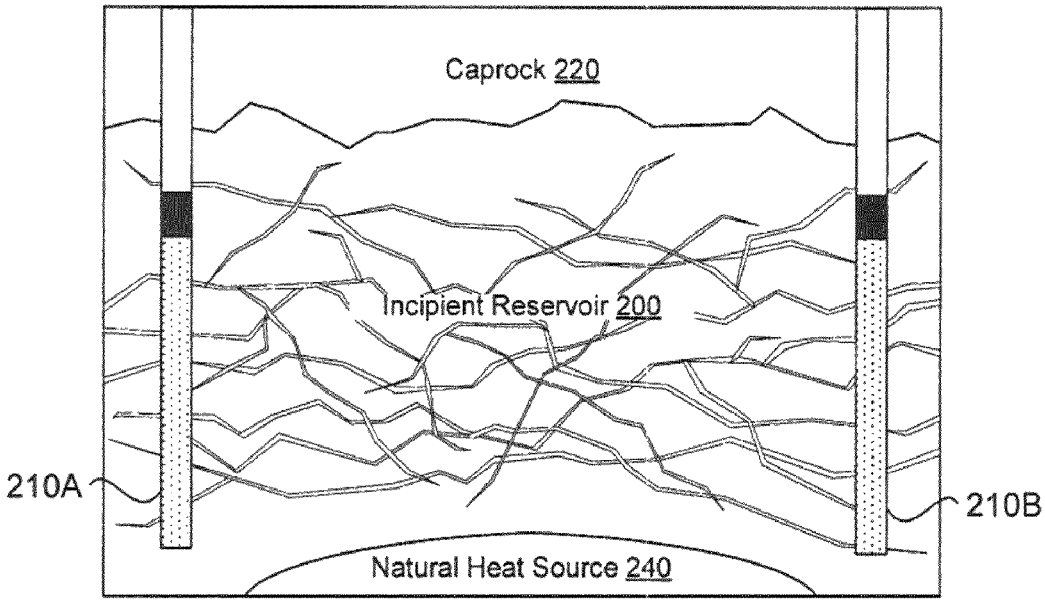
FIG. 2A is a schematic of an incipient reservoir having a mineralized fracture network under tectonically stressed conditions, according to one embodiment.
Figure 2B:
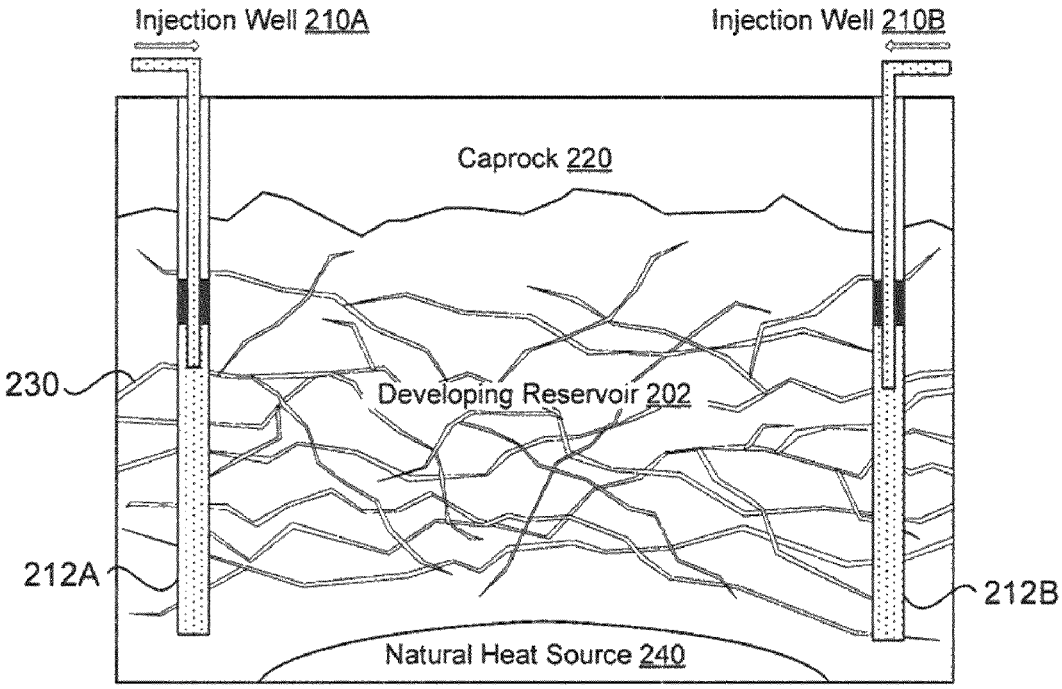
FIG. 2B is a schematic of two wells drilled adjacent the incipient reservoir showing water injected into adjacent rock to open, extend and/or connect fractures, according to one embodiment.
Figure 2C:
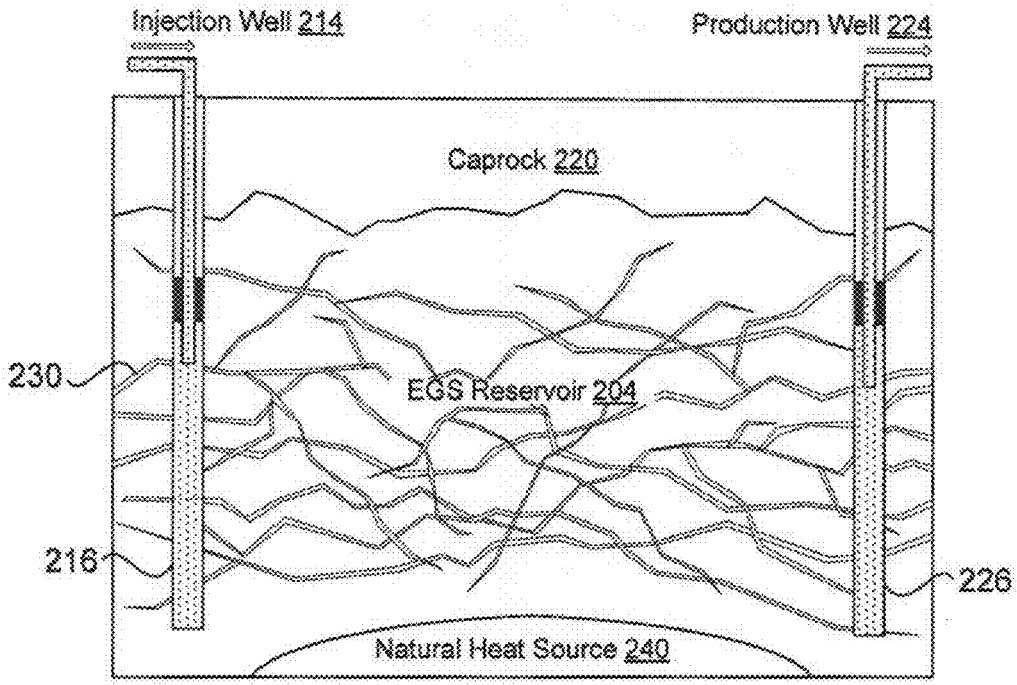
FIG. 2C is a schematic of a stimulated EGS reservoir which can be used to extract heat from a natural heat source to produce electric power, according to one embodiment.

FIG. 1 shows a general EGS 100 including a single injection well 110 and two production wells 120A and 120B. A large variety of configurations is possible in terms of number of wells, geometry, and the like. In this case, a fluid can be injected into the injection well where the fluid travels through fractures 130 in the adjacent formations outward towards the production wells. In the case of heat recovery, the fluid is heated via natural underground thermal sources 140. The production wells are located such that the heated fluid can be recovered and directed to a suitable heat transfer mechanism for producing power or the like, e.g. steam turbines 150. FIG. 2A illustrates one such stimulation method where two wells 210A and 210B are formed adjacent an incipient reservoir 200 between a caprock 220 and a natural heat source 240. Water or other fluid 212A and 212B is injected into the wells 210A and 210B and adjacent fractures under high pressure to hydraulically stress the fractures 230 in order to increase flow as illustrated by the developing reservoir 202 in FIG. 2B. Heat can then be extracted from the resulting higher flow reservoir 204 by circulating a heat transfer fluid 216 and 226 from the injection well 214 through the reservoir to the production well 224 as illustrated in FIG. 2C. This same hydraulic stimulation can increase production of any well based production of energy and/or materials (e.g. natural gas, oil, and the like). Increases in surface area can be equated to increased rates of energy extraction and/or natural resource recovery. Thus, the subterranean reservoir can be a geothermal reservoir, gas reservoir, oil reservoir, or combination thereof.

The integration of a tracing approach into conventional hydraulic stimulation procedures in order to measure the fracture-surface area created as part of that hydraulic stimulation is described. A method of measuring a surface area of a subterranean reservoir adjacent a geothermal well can include measuring an initial temperature profile along the length of a wellbore and using it to estimate the initial formation temperature adjacent the wellbore. A mixture of tracers can be injected into the well. The tracer mixture can be injected in any suitable manner such as, but not limited to, injection at the well head, delivery from a downhole conduit, delivery from a downhole deployable reservoir, or the like. For example, the tracer mixture can be injected via a conduit or hose passed down through the wellbore to a desired depth. Alternatively, a self-contained reservoir of tracer mixture can be lowered into the wellbore. Tracer mixture in the reservoir can then be released once the desired depth is reached.

The tracer mixture can be delivered alone or mixed with a suitable carrier fluid. In one aspect, the tracer mixture is delivered alone in order to avoid initial dilution. The tracer mixture can include a conservative tracer and a reactive tracer. The well can be shut in to allow the tracer mixture to diffuse within a subterranean reservoir for an extended time. As the well is then flowed to the surface, a conservative tracer concentration and a reactive tracer concentration can be measured as a function of time subsequent to the extended time. Although typically measured at the wellhead, concentrations measurements may also be made down hole. Based upon knowledge of the decay kinetics of the thermally reactive tracer, a reservoir fracture surface area can be calculated using a reservoir fluid flow model. The decay kinetics can be determined from literature and/or using standard techniques which account for temperature dependence of decay kinetics.

Typically, this approach can be performed as part of fracturing the subterranean reservoir. For example, the tracer composition can be injected during or after the stimulation of the reservoir. In this approach, one or more thermally-reactive tracers of known thermal decay kinetics and an unreactive or less reactive (conservative) secondary tracer can be pumped into the well with the stimulation fluid at a constant small concentration (e.g. 200 parts per billion each). Generally, the tracer mixture includes both a reactive tracer and a secondary tracer. The secondary tracer provides a dilution history or reference, while the reactive tracer can provide data sufficient to construct a temperature history. Alternatively, the tracer mixture can include a slightly reactive tracer in combination with a more reactive tracer. One aspect of the tracer mixture is that there is a measurable difference in the thermal decay kinetics between the tracers and that the thermal decay kinetics of each is known. Typically, tracers are chemically distinctive powders dissolved in aqueous solution. Alternatively, they can be chemically distinctive liquid compounds dissolved in an aqueous solution.

Thermally stable tracers are compounds that do not decompose during a reasonable time (months to years) at a given reservoir temperature. Therefore, some compounds that are thermally stable at a certain temperature are thermally unstable at other (higher) temperatures. These types of tracers can be suitable for use as conservative secondary tracers. Tracers that are thermally stable under nearly all subterranean conditions include, but not limited to deuterated water, alkali metals, alkaline-earth metals, and halides. Likewise, the benzene- and naphthalene sulfonates are thermally stable at subterranean temperatures below 340° C. Sodium fluorescein (uranine) is thermally stable below about 250° C.

Reactive tracers can include, but are not limited to, esters, amines, aryl halides, rhodamine WT, eosin Y, Oregon Green™, methylene blue, halogenated fluoresceins, and combinations thereof. In one specific aspect, the conservative tracer is 2,6-naphthalene disulfonate. In another specific aspect, the reactive tracer can be rhodamine VVT. Typically, it is desirous that the mixture of conservative and reactive tracers be in a 1:1 ratio. However, other ratios can be suitable. For example, in one optional embodiment, it can be desirable to overload the system with the reactive tracer since it will be consumed over time (e.g. a 2:1 to 10:1 ratio). For example, an initial ratio of 4 parts reactive tracer to one part conservative tracer can be used.

The concentration of either or both of the reactive and secondary tracers can depend on the particular tracer composition. More specifically, different tracer compounds are more or less sensitive to detection. Optimal detection systems can also depend on the particular compounds. Detection systems can include, but are not limited to, high-performance liquid chromatography (HPLC) With fluorescence or UV detection, spectrofluorimetry, filter fluorimetry, absorption spectroscopy, and the like. The initially injected tracer (either reactive or conservative) quantity can be enough to result in a produced concentration from about 0.1 ppb to about 100 ppb, such as about 0.1 ppb to about 100 ppb.

The geothermal well can be optionally shut-in when allowing the tracer to diffuse. Any shut-in duration can be used so long as the duration is not so long that it results in the complete thermal degradation of the reactive tracer. This can range from several minutes to several days.

Upon completion of the stimulation phase, which may last several days, the well can be flowed to the surface. The produced water can be sampled intermittently at the wellhead and analyzed for the reactive and secondary tracers. If downhole sampling is available, the well can be sampled without backflowing. More typically, however, the well can be allowed to backflow after stimulation. More specifically, the method can accompany the stimulation of the subterranean reservoir to increase the reservoir fracture surface area. In this case, injecting the tracer can occur when stimulating the formation and the measuring of the dilution concentration occurs during a backflow test of fluid from the subterranean reservoir.

The tracer composition concentrations can be measured at a wellhead of the geothermal well and optionally along the well depth. Further, the concentrations can be measured as a function of time during or immediately after stimulation and/or shut-in. Immediately after is intended to refer to a time frame where backflow is sufficient to allow measurement of fluids from the fracture. The concentrations can be measured as a function of time over several hours to days or weeks.

The data including the concentrations of the reactive and secondary tracers can be input to a computer program. Through a process of trial and error called inversion, the surface area that results in the best fit to the tracer data can be calculated. The behavior of the thermally-reactive tracer(s) and the secondary tracer can provide for a calculation of the fracture surface area for heat transfer. Based on the collected tracer concentration measurements and a wellbore temperature profile, the fracture surface area can be calculated using a corresponding reservoir fluid flow model. An inversion technique can be applied to the reservoir fluid flow model that includes a thermal decay model of the reactive tracer. In this manner, the reservoir fracture surface area that predicts the ratio of the reactive tracer concentration to that of the conservative tracer concentration as a function of time can be calculated. Although other models can be suitable, one particularly effective reservoir fluid flow model is TOUGH2 based on the Mulkom codes. Other models can include codes such as TETRAD (Vinsome, P. K. W. and Shook, G. M., 1993, "Multipurpose Simulation", J. Petroleum and Engineering, 9, pp. 29-38) and STAR (Pritchett, J. W., 1995, "STAR: A geothermal reservoir simulation system", Proceedings World Geothermal Congress 1995, Florence, pp. 2959-63), or other codes which numerically simulate heat flow of fluids through porous media. Both articles are incorporated herein by reference.

Using a numerical simulation code such as TOUGH2, a model can be constructed that predicts the thermal decay of the thermally reactive tracers upon exposure to the conditions of the tracer test. The model can be inverted to solve for the fracture surface area that gives the best fit to the thermally-reactive-tracer data. This is a trial-and-error process where numerical simulation techniques can be used to adjust the fracture surface area (a model input) until an appropriate match is obtained with the tracer output data.

Figure 3:
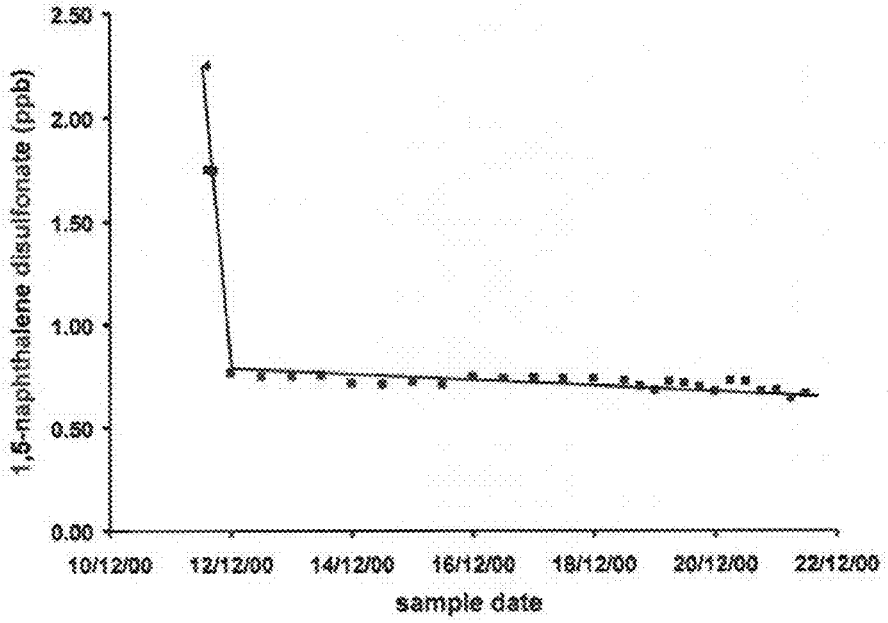
FIG. 3 is a graph of injection/backflow conservative tracer data in accordance with one embodiment.

The non-reactive tracer provides for a calculation of the dilution of the tagged injection fluid by the formation fluid over time. If dilution is large, the system is open and contains a large volume of natural waters (see FIG. 3). If dilution is small, the system is closed with a small volume of natural waters. An example of tracer data from a single-well injection/backflow test at the Soultz, France EGS reservoir is shown in FIG. 3. The figure shows the behavior of a conservative tracer during the backflow portion of the experiment only. FIG. 3 is a graph of tracer data showing the results of an injection/backflow experiment, according to one embodiment. Each point represents the concentration of tracer from water sampled during backflow. The early steeply dipping line represents the concentration of tracer within the wellbore. The points along the nearly horizontal line show the concentration at the wellhead.

Figure 4:
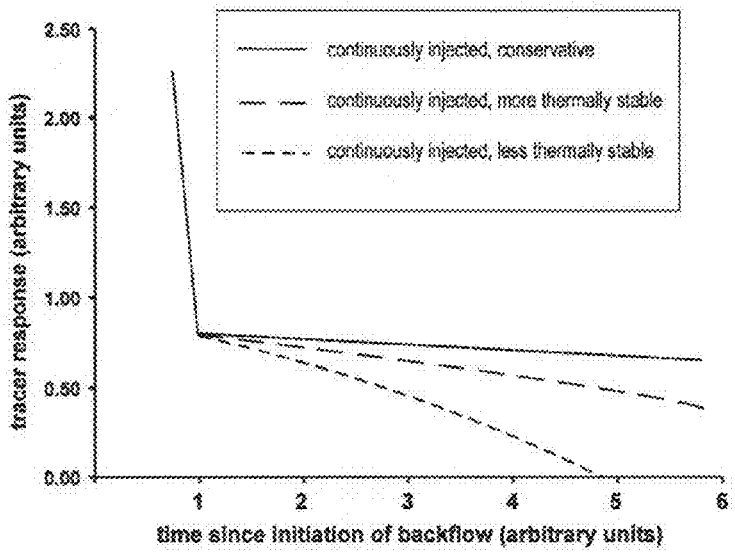
FIG. 4 is a graph of injection/backflow tracer composition data showing theoretical conservative and reactive tracer data in accordance with one embodiment.

FIG. 4 shows a theoretical expected return of the conservative and reactive tracers during the injection/backflow approach described herein, according to one embodiment. The conservative tracer reappears as shown in FIG. 3. The other two curves in FIG. 4 represent the expected behavior of two thermally reactive tracers possessing arbitrary thermal decay kinetics. The decay kinetics of the thermally reactive tracer should be sufficiently great that there is a measurable difference between its concentration and that of the conservative tracer. Its decay should generally not be so rapid, however, that it disappears before it can be measured. Ideally, two or more tracers possessing a range of thermal stabilities can be used in order to assure that at least one experiences appropriate decay under the conditions of the test. The tracers possessing various properties can be injected either continuously or as pulses.

Figure 5:
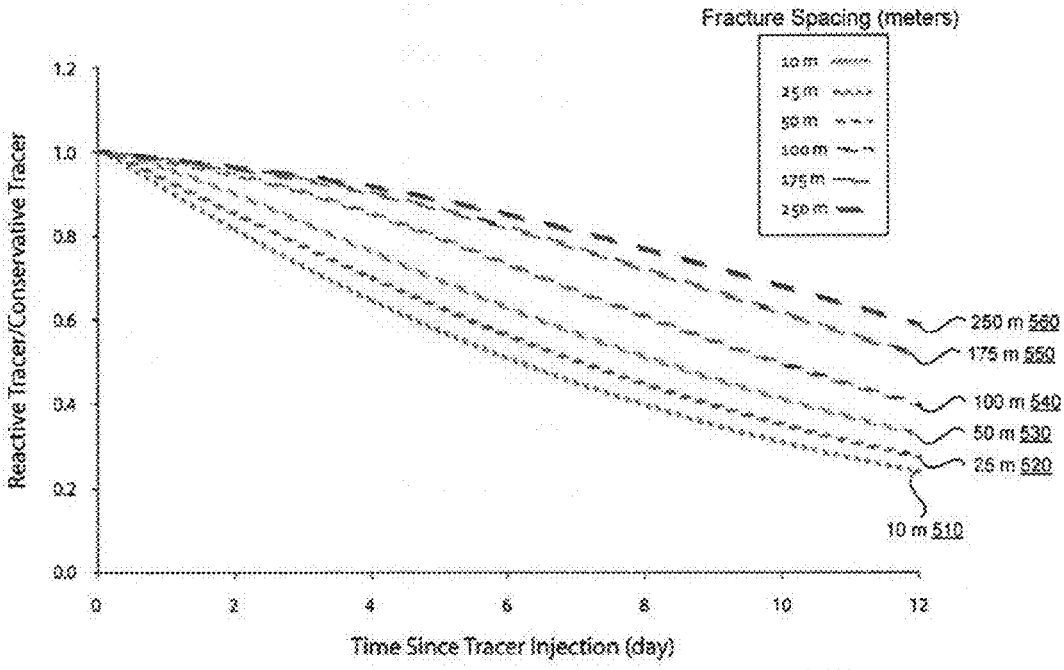
FIG. 5 shows the results of a numerical model of an injection backflow experiment, according to one embodiment. The plotted lines are the concentrations of the thermally reactive tracer divided by the concentrations of the thermally stable (conservative) tracer for a reservoir with varying fracture density. The numerical experiment indicates that as fracture density increases (i.e. fracture spacing decreases), normalized tracer decay increases.

FIG. 5 shows the results of the numerical modeling of an injection backflow experiment, according to one embodiment. The plotted lines are the concentrations of the thermally reactive tracer divided by the concentrations of the thermally stable (conservative) tracer for a reservoir with varying fracture density. The numerical experiment indicates that as fracture density increases (i.e. fracture spacing decreases), normalized tracer decays progressively with time. The plotted lines are the concentrations of the thermally reactive tracer divided by the concentrations of the thermally stable (conservative) tracer for a reservoir with varying fracture density. The numerical experiment indicates that as fracture density increases (i.e. fracture spacing decreases), the concentration of the reactive tracer divided by that of the conservative tracer decreases. This means that as the fracture density increases the fracture surface area increases, which in turn means that the surface area for heat transfer increases. For example as illustrated by FIG. 5, a fracture spacing of 250 meters 560 (a lower fracture density or a smaller fracture surface area) has a higher concentration of the reactive tracer for a concentration of the conservative tracer than a fracture spacing of 10 meters 510 (a higher fracture density or a larger fracture surface area), which increases as a function of time. Other fracture spacings 520-550 are also shown. This is a consideration in the construction of an Engineered Geothermal System, because as the surface area for heat transfer increases the more heat and electricity can be generated for each well. By measuring the fracture surface area, it is possible to more accurately estimate the amount of heat that can be generated by the well.

The foregoing detailed description describes the system and methods with reference to specific exemplary embodiments. However, it will be appreciated that various modifications and changes can be made without departing from their scope. The detailed description and accompanying drawings are to be regarded as merely illustrative, rather than as restrictive, and all such modifications or changes, if any, are intended to fall within the scope of the invention as described and set forth herein.

What is claimed is:

1. A method, comprising:

measuring an initial temperature profile along the length of a wellbore;

injecting a tracer composition into the wellbore at an initial concentration, wherein the tracer composition includes a first thermally reactive tracer and a second thermally reactive tracer, wherein the second thermally reactive tracer is less thermally reactive than the first thermally reactive tracer;

allowing the tracer composition to diffuse within a subterranean reservoir for a time;

measuring a second tracer concentration of the second thermally reactive tracer and a first tracer concentration of the first thermally reactive tracer as a function of time; and calculating a reservoir fracture surface area using the second tracer concentration and the first tracer concentration and thermal decay information of the first thermally reactive tracer and the second thermally reactive tracer.

2. The method of claim 1, further comprising fracturing a subterranean reservoir adjacent the wellbore prior to or during the injecting of the tracer composition.

3. The method of claim 1, wherein the second thermally reactive tracer is a conservative tracer.

4. The method of claim 3, wherein the second thermally reactive tracer is selected from the group consisting of deuterated water, alkali metals, alkaline-earth metals, halides, and combinations thereof.

5. The method of claim 3, wherein the second thermally reactive tracer is 2,6-naphthalene disulfonate.

6. The method of claim 1, wherein the first thermally reactive tracer is selected from the group consisting of esters, amines, aryl halides, rhodamine WT, eosin Y, dyes, halogenated fluoresceins, and combinations thereof.

7. The method of claim 1, wherein the initial concentration of the first thermally reactive tracer or the initial concentration of the second thermally reactive tracer is from about 0.1 ppb to about 100 ppb.

8. The method of claim 1, further comprising shutting-in the wellbore when allowing the tracer composition to diffuse for an extended shut-in time.

9. The method of claim 8, wherein the extended shut-in time is from about 6 hours to about 4 days.

10. The method of claim 1, wherein the time is from ten minutes to 4 hours.

11. The method of claim 1, further comprising stimulating a subterranean reservoir adjacent the wellbore to increase the reservoir fracture surface area, and wherein the injecting the tracer composition occurs when stimulating the subterranean reservoir, and wherein the measuring the second tracer concentration occurs during a backflow of fluid from the subterranean reservoir.

12. The method of claim 1, wherein the measuring the second tracer concentration uses liquid chromatography, spectrofluorimetry, filter fluorimetry, or absorption spectroscopy.

13. The method of claim 1, wherein the measuring the secondary tracer concentration occurs at a wellhead of the wellbore.

14. The method of claim 1, wherein the calculating the reservoir fracture surface area comprises applying an inversion technique to the thermal decay model of the first thermally reactive tracer to calculate the reservoir fracture surface area.

15. The method of claim 1, wherein the reservoir fluid flow model is run in a numerical simulation program.

16. The method of claim 1, wherein the reservoir fluid flow model includes an estimate of an original reservoir temperature.

17. The method of claim 1, further comprising shutting-in the wellbore subsequent to the injecting the tracer composition and prior to measuring the secondary tracer concentration.

18. The method of claim 1, wherein a subterranean reservoir adjacent the wellbore is a geothermal reservoir, gas reservoir, oil reservoir, or combination thereof.

* * * * *